US010791792B2

(12) United States Patent
Davila et al.

(10) Patent No.: US 10,791,792 B2
(45) Date of Patent: Oct. 6, 2020

(54) APPARATUS AND METHOD FOR SECURING AN UPPER TO A SOLE

(71) Applicant: NIKE, Inc., Beaverton, OR (US)

(72) Inventors: Jason Davila, Round Rock, TX (US); Stephen Hancock, Wake Forest, NC (US); Adam Montoya, Shepherdsville, KY (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/286,264

(22) Filed: Feb. 26, 2019

(65) Prior Publication Data

US 2019/0191818 A1 Jun. 27, 2019

Related U.S. Application Data

(62) Division of application No. 15/365,386, filed on Nov. 30, 2016, now Pat. No. 10,244,819.
(Continued)

(51) Int. Cl.
*A43B 9/12* (2006.01)
*A43D 25/06* (2006.01)
(Continued)

(52) U.S. Cl.
CPC ..... *A43B 9/12* (2013.01); *A43B 13/32* (2013.01); *A43D 5/00* (2013.01); *A43D 5/02* (2013.01); *A43D 25/06* (2013.01)

(58) Field of Classification Search
CPC ..... A43D 25/06; A43D 25/18; A43D 25/183; A43D 25/07; A43D 25/08; A43D 25/10
See application file for complete search history.

(56) References Cited

U.S. PATENT DOCUMENTS 829,656 A 8/1906 Knipe
1,142,557 A 6/1915 Engel
(Continued)

FOREIGN PATENT DOCUMENTS

CN 203492907 U 3/2014
CN 104905493 A 9/2015
(Continued)

OTHER PUBLICATIONS

EN 344 Whole Rubber or Leather Shoe Sole Bending/Flexing Testing Machine. Alibaba.com. https://www.alibaba.com/product-detail/EN-344-whole-rubber-or-leather_60784030313.html?spm=a2700.7724857.normalList.2.649313a12W5b3h&s=p.
(Continued)

*Primary Examiner* — Ted Kavanaugh
(74) *Attorney, Agent, or Firm* — Shook, Hardy & Bacon L.L.P.

(57) ABSTRACT

Aspects hereof relate to a method for coupling a cemented upper to a sole of an article of footwear. Pairs of clamps secure a sole at a forefoot region and a heel region to prevent movement of a location of the sole upon application of a perimeter deforming force. Perimeter deforming implements apply such force to a bottom surface of the secured sole causing the perimeter of the top surface of the sole to splay open outwardly from the longitudinal axis of the sole. While the top surface of the perimeter is splayed, a cemented upper is caused to contact the top surface of the sole in a longitudinal direction from the heel end to the toe end. Once in place, the force on the bottom surface of the secured sole and the clamps is released leaving the top surface of the sole properly adhered to the upper.

11 Claims, 12 Drawing Sheets

Related U.S. Application Data

(60) Provisional application No. 62/261,701, filed on Dec. 1, 2015.

(51) Int. Cl.

| | |
|---|---|
| ***A43B 13/32*** | (2006.01) |
| ***A43D 5/00*** | (2006.01) |
| ***A43D 5/02*** | (2006.01) |

(56) References Cited

U.S. PATENT DOCUMENTS

| | | | |
|---|---|---|---|
| 1,531,612 | A | 3/1925 | Hill |
| 1,707,510 | A | 4/1929 | Colditz |
| 2,464,130 | A | 3/1949 | Guercio |
| 2,623,984 | A | 12/1952 | Ashley |
| 2,947,033 | A | 8/1960 | Ryan |
| 9,095,191 | B2 | 8/2015 | Liebeno |
| 2017/0150776 | A1 | 6/2017 | Montoya |

FOREIGN PATENT DOCUMENTS

| | | | |
|---|---|---|---|
| FR | 2309172 | A1 | 11/1976 |
| JP | S53080546 | U | 7/1978 |
| KR | 20060090337 | A | 8/2006 |
| WO | 2010037034 | A1 | 4/2010 |
| WO | 2014100337 | A1 | 6/2014 |

OTHER PUBLICATIONS

Communication under Rule 71(3) dated Apr. 29, 2019 in European Patent Application No. 16813273.6, 7 pages.

APPARATUS AND METHOD FOR SECURING AN UPPER TO A SOLE

CROSS-REFERENCE TO RELATED APPLICATIONS

This application entitled "Apparatus And Method For Securing An Upper To A Sole" is a Divisional application of U.S. application Ser. No. 15/365,386 entitled "Apparatus And Method For Securing An Upper To A Sole," and filed on Nov. 30, 2016, which claims the benefit of U.S. Provisional Application No. 62/261,701, entitled "Apparatus And Method For Securing An Upper To A Sole," and filed on Dec. 1, 2015. The entirety of the aforementioned applications are incorporated by reference herein.

TECHNICAL FIELD

Aspects hereof relate to an apparatus and method for securing an upper to a sole of an article of footwear. More particularly, the present disclosure relates to an apparatus and method for securing a sole in place, outwardly splaying the medial and lateral perimeter edges thereof, and coupling a cemented upper with the sole while the edges are splayed.

BACKGROUND

Adhesives utilized to cement uppers to soles of articles of footwear generally are rapid set. Thus, once an adhesive is applied to an upper, the upper quickly ought to be coupled with the sole to insure proper adhesion. Equally challenging is proper placement of an upper with respect to the sole. Undesired contact between an upper with adhesive applied thereto and a portion of the sole may result in adherence that cannot be altered without damaging the upper and/or the sole. As such, proper coupling of a cemented upper and sole is not only manually-intensive but requires highly skilled workers that often take years to properly train. Accordingly, a method for accurately coupling a cemented upper and a sole for an article of footwear that requires less skill is desirable.

BRIEF SUMMARY

At a high level, aspects hereof relate to an apparatus and method for coupling a cemented upper to a sole of an article of footwear. Clamps secure a sole at a forefoot region and a heel region to prevent appreciable movement of a location of the sole upon application of a perimeter deforming force. Perimeter deforming implements apply such force to a bottom surface of the secured sole causing the perimeter of the top surface of the sole to outwardly splay open. While the perimeter of the top surface is splayed, a cemented upper is caused to contact the top surface of the sole in a longitudinal direction from the heel end to the toe end. Once in place, the force on the bottom surface of the secured sole and the clamps may be released leaving the top surface of the sole properly adhered to the upper on at least a bottom surface thereof.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Illustrative aspects hereof are described in detail below with reference to the attached drawing figures, which are incorporated by reference herein and wherein.

DETAILED DESCRIPTION

Figure 1:
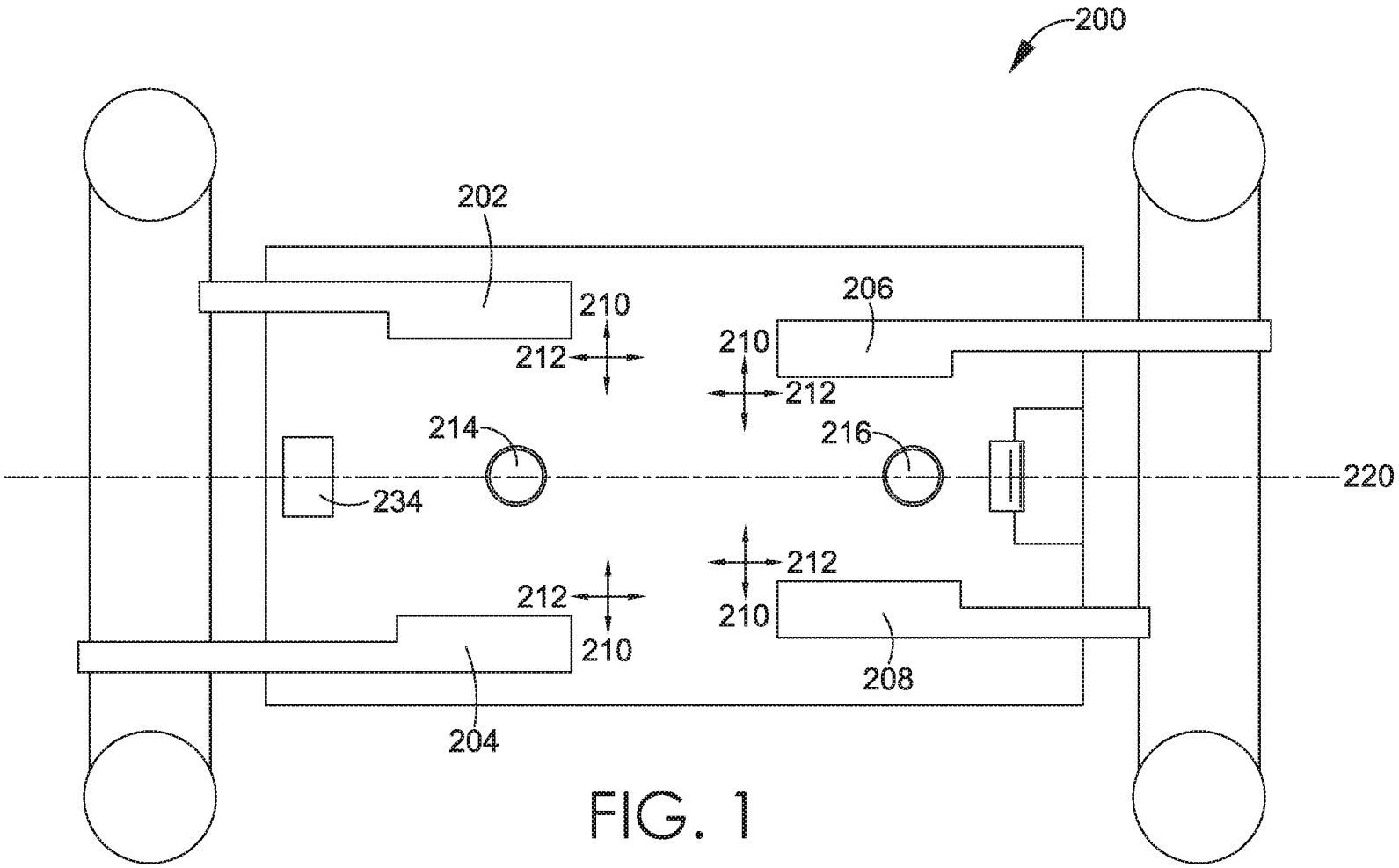
FIG. 1 depicts a top view of an exemplary manufacturing apparatus, in accordance with aspects hereof.

The subject matter herein is described with specificity to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects hereof contemplate a manufacturing apparatus that is effective for permitting placement of a cemented upper in proper positional contact with a sole for coupling the upper and the sole to form an article of footwear. For example, it is contemplated that at least two pairs of clamps are positioned opposite on another at a ball region and heel region of a sole, respectively, at a distance from one another sufficient to receive a sole for which coupling to an upper is desired. It is further contemplated that at least two perimeter deforming implements are positioned at or near a central longitudinal axis of the manufacturing apparatus, one at or near the region of the apparatus that will receive the ball region of the sole and the other at or near the region of the apparatus that will receive the heel region of the sole. Upon actuation, the perimeter deforming implements may press substantially vertically against the bottom surface of the sole at those regions where the implements contact the bottom surface. The force caused by the vertical pressing may cause a convex curvature of the sole at those regions surrounding the points of contact by the perimeter deforming implements. Also caused may be an outward splaying of the perimeter of a top surface of the sole. Such outward splaying may render the sole uniquely ready to receive a cemented upper as the perimeter of the top surface of the sole is out of the way making it less likely that it will interfere with proper placement of the upper. Insuring proper placement of a cemented upper on a sole may decrease the chance that improperly placed and, thus, unusable articles of footwear will result.

In general, aspects herein are directed toward an apparatus and method for coupling a cemented upper (i.e., an upper having an adhesive applied thereto) and a sole of an article of footwear, e.g., a shoe. A sole may be secured in place at a ball region and a heel region to prevent movement of the location of the sole. Perimeter deforming implements may apply a force to the bottom surface of the ball and heel regions of the secured sole. The perimeter deforming force may cause at least a portion of the perimeter of the top surface of the sole to open outwardly from a central longitudinal axis thereof. While the perimeter of the top surface is splayed, a cemented upper is caused to contact the top surface of the sole in a longitudinal direction from the heel end to the toe end. Once in place, the perimeter deforming force may be released leaving the top surface of the sole adhered to the upper on at least a bottom surface thereof.

Figure 10:
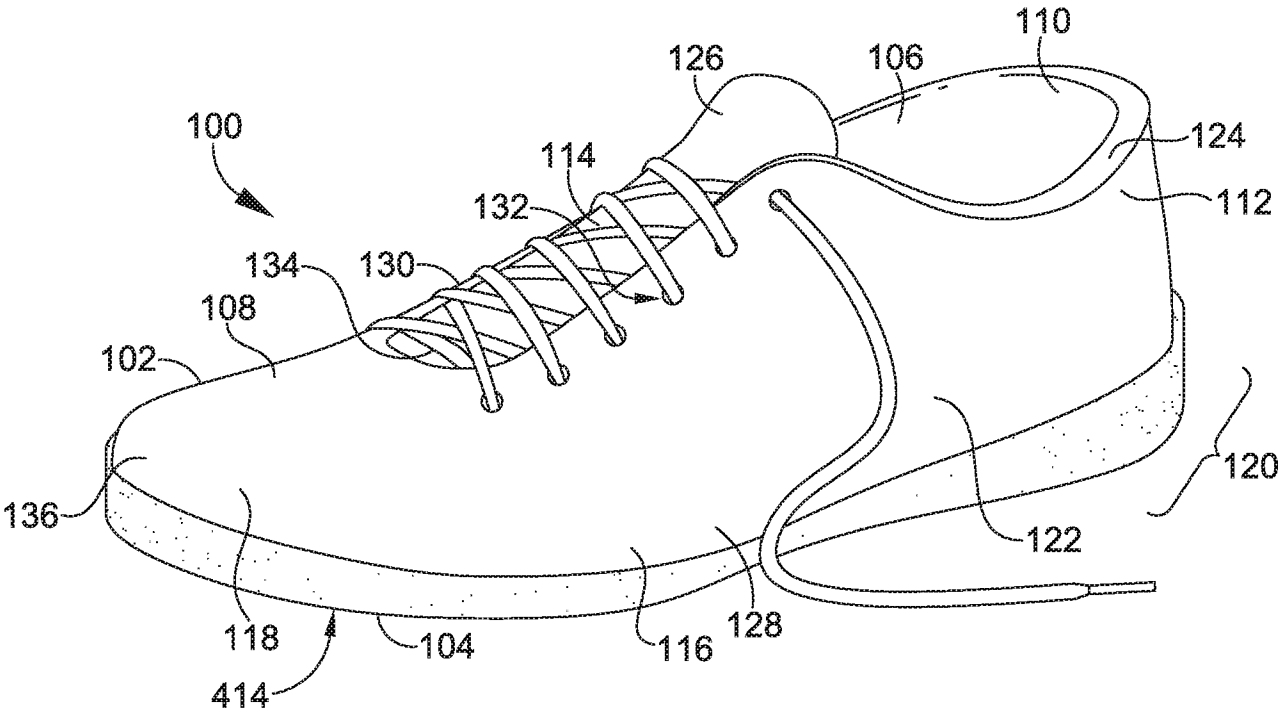
FIG. 10 depicts an exemplary article of footwear manufactured, at least in part, in accordance with aspects hereof.

With initial reference to FIG. 10, depicted is an article of footwear 100 manufactured, at least in part, in accordance with various aspects hereof, as more fully described below. The article of footwear 100 has a general configuration suitable for various activities, such as walking, running, and the like. Exemplary articles of footwear may include, without limitation, shoes, sandals, dress shoes, boots, loafers, and the like. The term "shoe" may be used herein for simplicity, in reference to various aspects of the articles of footwear. However, concepts described herein may be applied to a variety of other types of footwear.

The shoe 100 of FIG. 10 can generally include an upper 102 and a sole 104. The sole 104 may include multiple components, such as one or more of an insole, a midsole, and an outsole. An insole can be an interior bottom of a shoe that sits directly beneath a person's foot under the footbed (commonly known as the sock liner). Insoles can be made from cellulosic paper board, synthetic nonwoven insole board, polymer-based materials, or the like. A midsole can be added underneath the insole for comfort; to control the shape, moisture, or smell of a shoe; or for managing defects in the natural shape of the foot or positioning of the foot during standing, walking, running, etc. Midsoles may be made or integrated from foam, foam-cushioning sheets, latex, ethylene-vinyl acetate ("EVA"), polyurethane, plastic, thermoplastic, or a blend thereof. An outsole can be connected to the bottom of the midsole. Outsoles are layers of a shoe made for directly contacting the ground. Casual or athletic shoes usually have outsoles made from natural rubber, plastic, or a synthetic material like polyurethane. The outsole may comprise a single piece of material or may be an assembly of separate pieces of different materials.

Generally, the upper 102 can be secured to the sole 104 and defines a cavity 106 for receiving a foot. As more fully described below, the upper 102 can be secured to the sole 104 utilizing an apparatus and methods as described herein. The upper 102 may be comprised of an outer portion 108 and an inner portion 110. In aspects, the inner portion 110 is a portion of the upper 102 that is in contact with at least a portion of a wearer's foot when positioned inside the cavity 106. The inner portion 110 may be affixed to the outer portion 108 in any manner known to one skilled in the art, such as by the use of stitching, adhesives, ultrasound, heat, and/or light. The inner portion 110 and the outer portion 108 can be affixed to one another at any location of the shoe 100. In an exemplary aspect, the inner portion 110 can be affixed to the outer portion 108 at or near the ankle collar 124 of the shoe 100.

The upper 102 can be divided into several general areas including: an ankle collar perimeter area 112, a forefoot opening area 114, a sole perimeter area 116, a toe box area 118, a heel area 120, and an intermediate area 122. The ankle collar perimeter area 112 generally can be defined as including the ankle collar 124 and, approximately, a three centimeter perimeter area around the ankle collar 124. The forefoot opening area 114 generally can be defined as including the opening for the tongue 126, the plurality of eyestays 132, and, approximately, a three centimeter perimeter around the plurality of eyestays 132. The sole perimeter area 116 generally can be defined as including, approximately, a three centimeter perimeter area of the upper 102 adjacent to the sole 104. The toe box area 118 generally can be defined as including the portion of the upper 102 from the toe-ward edge 134 of the forefoot opening area 114 to the toe end 136 of the shoe 100. The heel area 120 generally can be defined as including the portion of the upper 102 defined by the area identified in FIG. 1 that is between the sole perimeter area 116 and the ankle collar perimeter area 112. The intermediate area 122 generally can be defined as the area of the upper that is distinct from the ankle collar perimeter area 112, the forefoot opening area 114, the sole perimeter area 116, the toe box area 118, and the heel area 120.

The shoe 100 also includes a lateral side 128 and a medial side 130. The lateral side 128 extends along a lateral side of a wearer's foot when in the cavity 106, and generally includes the ankle collar perimeter area 112, the forefoot opening area 114, the sole perimeter area 116, the toe box area 118, the heel area 120, and the intermediate area 122. The medial side 130 extends along a medial side of the wearer's foot when in the cavity 106 and also includes the ankle collar perimeter area 112, the forefoot opening area 114, the sole perimeter area 116, the toe box area 118, the heel area 120, and the intermediate area 122. The lateral side 128, the medial side 130, the ankle collar perimeter area 112, the forefoot opening area 114, the sole perimeter area 116, the toe box area 118, the heel area 120, and the intermediate area 122 are not intended to demarcate specific areas of the upper 102 and/or the shoe 100. Instead, they are intended to represent general areas of the upper 102 and/or the shoe 100 and are used for reference purposes for the following discussion.

Figure 2:
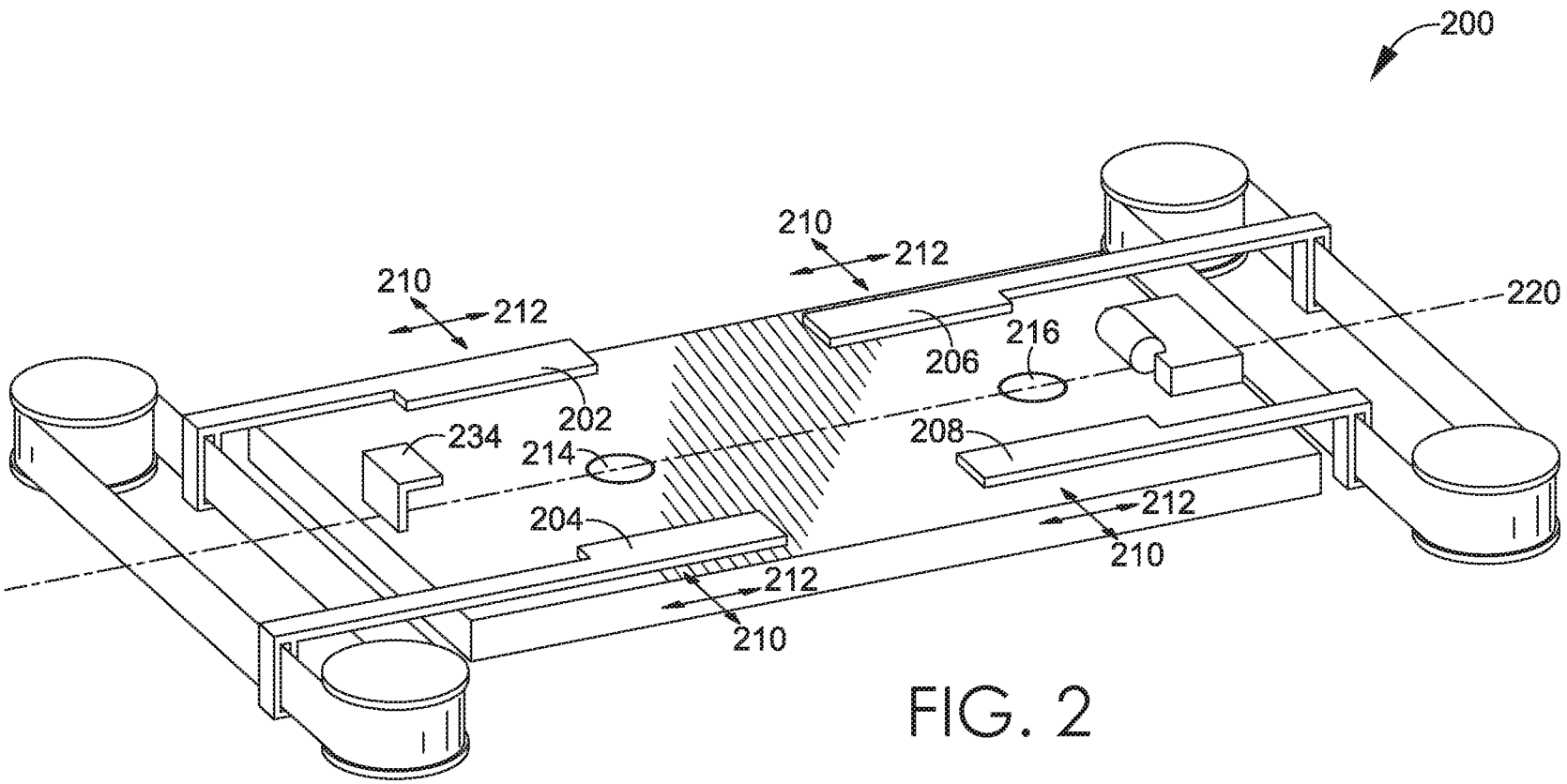
FIG. 2 depicts a perspective view of an exemplary manufacturing apparatus, in accordance with aspects hereof, the apparatus having perimeter deforming implements in a non-actuated position.
Figure 3:
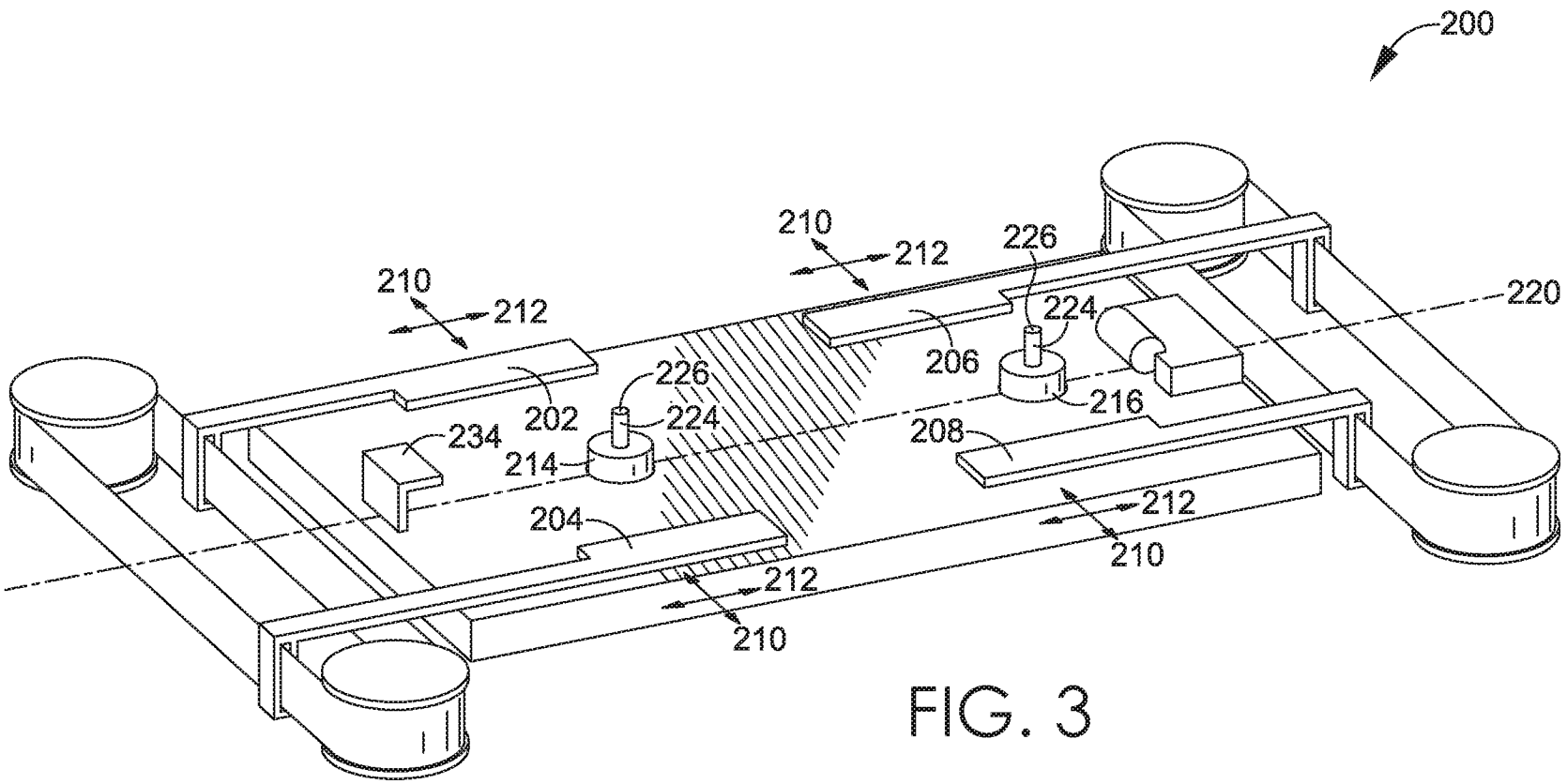
FIG. 3 depicts a perspective view of the exemplary manufacturing apparatus of FIG. 2, the apparatus having perimeter deforming implements in an actuated position, in accordance with aspects hereof.

With reference now to FIGS. 1, 2 and 3, depicted is a manufacturing apparatus 200 for use with aspects hereof. The manufacturing apparatus generally is configured to secure a sole of a shoe to prevent appreciable movement of a location thereof, and to apply a perimeter deforming force to a bottom surface of the secured sole causing at least a medial rim and a lateral rim of the perimeter of the top surface of the sole to outwardly splay in preparation for receipt of a cemented upper. In this regard, the manufacturing apparatus 200 may include a first pair of clamps 202, 204 and a second pair of clamps 206, 208. As more fully described below with reference to FIGS. 4 through 7, the first pair of clamps 202, 204 may be positioned to secure a sole at the ball region thereof. In aspects, the first pair of clamps 202, 204 may be positioned approximately laterally in line with the toe-ward edge of the forefoot opening of an upper when the upper is coupled with the sole, as more fully described below. A first 202 of the first pair of clamps may be a medial clamp configured for positioning at the ball region of the sole along a medial edge thereof, as more fully described below. A second 204 of the first pair of clamps may be a lateral clamp configured for positioning at the ball region of the sole along a lateral edge thereof. The first pair of clamps 202, 204 may cooperate with one another to secure the ball region of the sole in place when the sole is engaged in the apparatus 200, as more fully described below.

In aspects, the second pair of clamps 206, 208 may be positioned to secure a sole at the heel region thereof. A first 206 of the second pair of clamps may be a medial clamp configured for positioning at the heel region of the sole along a medial edge thereof, as more fully described below. A second 208 of the second pair of clamps may be a lateral clamp configured for positioning at the heel region of the sole along a lateral edge thereof. The second pair of clamps 206, 208 may cooperate with one another to secure the heel region of the sole in place when the sole is engaged in the apparatus, as more fully described below.

The first pair of clamps 202, 204 and the second pair of clamps 206, 208 may employ any technique for holding an engaged sole in place such as, for instance, application of opposing forces. It will be understood that the manner in which the clamps 202, 204, 206, 208 secure a sole is not intended to limit the scope of aspects hereof, nor is use of the word "clamp." Rather, "clamp," as the term is utilized herein, is synonymous with, e.g., lock, brace, immobilizer, or any other term intended to represent a structure having the purpose of securing an object in place. In aspects, at least one of the first pair of clamps 202, 204 and/or at least one of the second pair of clamps 206, 208 may be adjustable in a latitudinal direction 210 relative to the manufacturing apparatus 200 and/or in a longitudinal direction 212 relative to the manufacturing apparatus 200 to accommodate soles for articles of footwear that have different sizes and shapes, as well as to accommodate soles for shoes configured to be worn on a wearer's left foot and shoes configured to be worn on a wearer's right foot.

The manufacturing apparatus further may include a first perimeter deforming implement 214 and a second perimeter deforming implement 216. The first perimeter deforming implement 214 may be positioned in cooperation with a sole-receiving surface 218 of the manufacturing apparatus 200 laterally proximate the position of the first pair of clamps 202, 204. In aspects, the first perimeter deforming implement 214 may be positioned at or near the central longitudinal axis 220 of the manufacturing apparatus 200. The second perimeter deforming implement 216 may be positioned in cooperation with the sole-receiving surface 218 of the manufacturing apparatus 200 laterally proximate the position of the second pair of clamps 206, 208. In aspects, the second perimeter deforming implement 216 may be positioned at or near the central longitudinal axis 220 of the manufacturing apparatus 200. In aspects, at least one of the first pair of clamps 202, 204, the second pair of clamps 206, 208 and the first and second perimeter deforming implements 214, 216 may be adjustable in a latitudinal direction 210 relative to the manufacturing apparatus 200 and/or in a longitudinal direction 212 relative to the manufacturing apparatus 200 to accommodate soles for articles of footwear that have different sizes and shapes, as well as to accommodate soles for shoes configured to be worn on a wearer's left foot and shoes configured to be worn on a wearer's right foot.

When the manufacturing apparatus 200 is in a non-actuated state, a top surface 226 of each of the first and second perimeter deforming implements 214, 216 may be substantially planar with the sole-receiving surface 218 of the manufacturing apparatus. This non-actuated state of the manufacturing apparatus 200 is depicted in FIG. 2. In aspects, each of the first and second perimeter deforming implements 214, 216 may be configured to vertically rise when actuated, applying a force to sole engaged with the manufacturing apparatus 200, as more fully described below. This actuated state of the manufacturing apparatus 200 is depicted in FIG. 3. As more fully described below, such vertical rise may cause a convex curvature of a bottom surface of an engaged sole secured between the first and second pairs of clamps 202, 204, 206, 208 which may, in turn, cause a deformity or outward splaying of at least a medial rim and a lateral rim of the perimeter of the top surface of the secured sole. In aspects, each of the first and second perimeter deforming implements 214, 216 may comprise a vertical piston.

In aspects hereof, the manufacturing apparatus 200 additionally may include a toe securing element 234 configured to secure a toe end of a sole when the sole is engaged in the manufacturing apparatus 200. Securing the toe end of a sole while an upper is in the process of being coupled therewith may aid in decreasing any unwanted movement of a secured sole during coupling. The toe securing element 222 may be positioned proximate the first pair of clamps 202, 204 at a position configured for receiving a toe end of an engaged sole. In aspects, the toe securing element 222 may be positioned at or near the central longitudinal axis 220 of the manufacturing apparatus 200.

Sufficient deformity of the lateral and medial rims of the top surface of the perimeter, as more fully described below, may be achieved by optimizing the surface area of the bottom surface of the sole that is in contact with the first and second perimeter deforming implements 214, 216. Too much contact may cause a rising of the sole without a sufficient degree of splaying to enhance the ease with which an upper may be coupled with the sole. Too little contact however, may cause puncture of the bottom surface of the sole resulting in an unusable article. By way of example, a second perimeter deforming implement 216 that contacts roughly 30% of the heel region of the sole leaves little room between the second pair of clamps 206, 208 and the second perimeter deforming implement 216 to affect splaying of the perimeter of the top surface of the sole near the heel region. As such, in aspects, a reducing element 224 may be secured to the top surface 226 of one or both of the perimeter deforming implements 214, 216 to reduce the amount of surface area in contact with the bottom surface of the sole as a result of actuation of the perimeter deforming implements 214, 216. The exact size and shape of the reducing element 224 may be adjusted based upon many variables including, but not limited to, the size of the sole to which an upper is being coupled, the material or materials comprising the sole, and the like.

Figure 4:
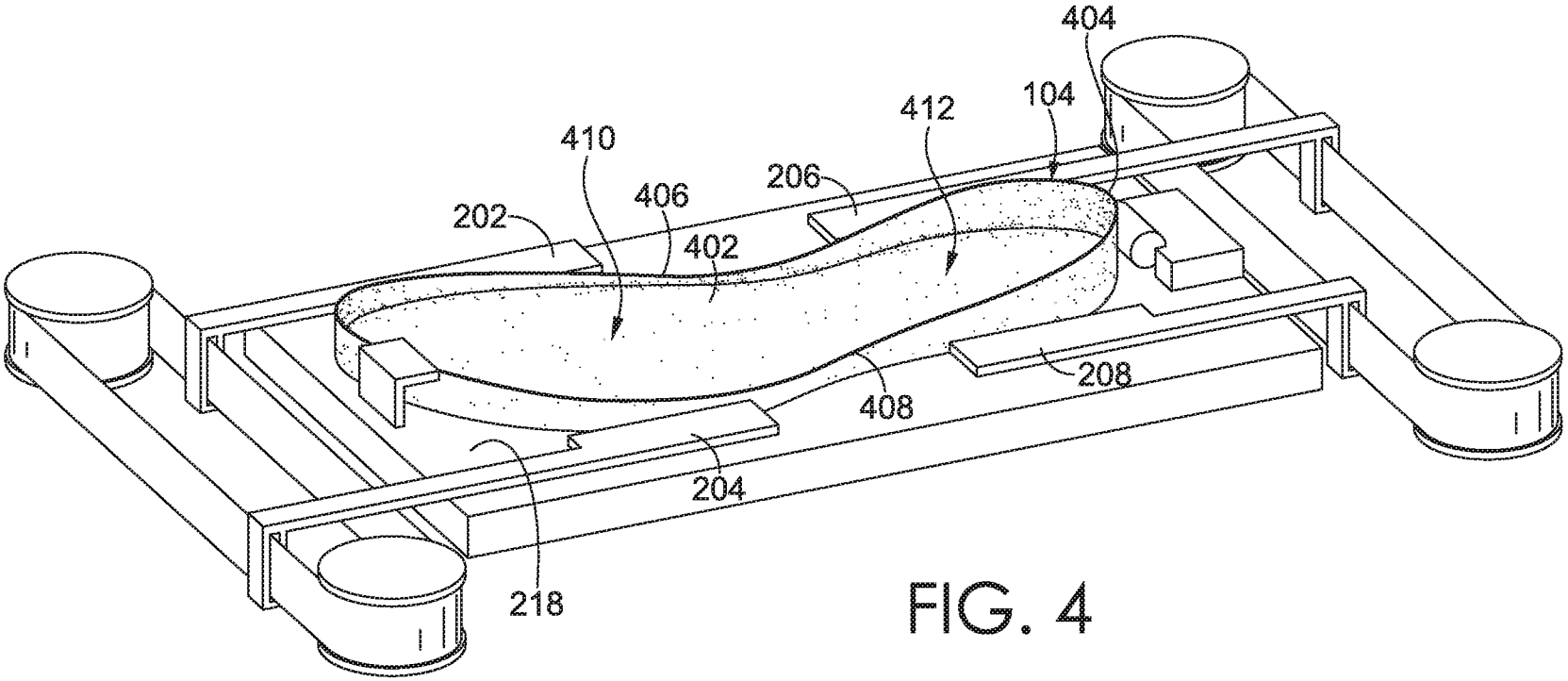
FIG. 4 depicts a perspective view of the exemplary manufacturing apparatus of FIGS. 2 and 3, the apparatus having a sole placed in cooperation therewith, in accordance with aspects hereof.

Turning now to FIG. 4, depicted is the manufacturing apparatus 200 of FIGS. 1 through 3 having a sole 104 received on the sole-receiving surface 218 thereof. The sole 104 may include a top surface 402 having a perimeter 404, the perimeter 404 having a medial rim 406 and a lateral rim 408. A ball region 410 of the sole 104 may be positioned between the first pair of clamps 202, 204. A heel region 412 of the sole 104 may be positioned between the second pair of clamps 206, 208.

Once the sole 104 is positioned on the sole-receiving surface 218 as depicted in FIG. 4, the first pair of clamps 202, 204 and the second pair of claims 206, 208 may be actuated, for instance, may be caused to generate opposite forces against the sole 104 toward one another, securing the sole 104 in place. This is depicted in FIG. 6. Note that in the illustrations of FIGS. 4 through 6, the first and second perimeter deforming implements 214, 216 (not shown) are in their non-actuated positions.

In aspects, once the sole 104 is secured in place in the manufacturing apparatus 200 such that appreciable movement of a location of the sole 104 is prevented, the first and second perimeter deforming implements 214, 216 may be actuated. When actuated, the perimeter deforming implements 214, 216 apply a vertical force to a bottom surface (not shown) of the secured sole 104 causing a convex curvature of the bottom surface 414 surrounding each of the first and second perimeter deforming implements 214, 216. Such convex curvature causes the perimeter 404 of the top surface 402 of the sole 104 to outwardly splay open at least along the medial rim 406 and the lateral rim 408 thereof, as shown in FIG. 7.

Figure 5:
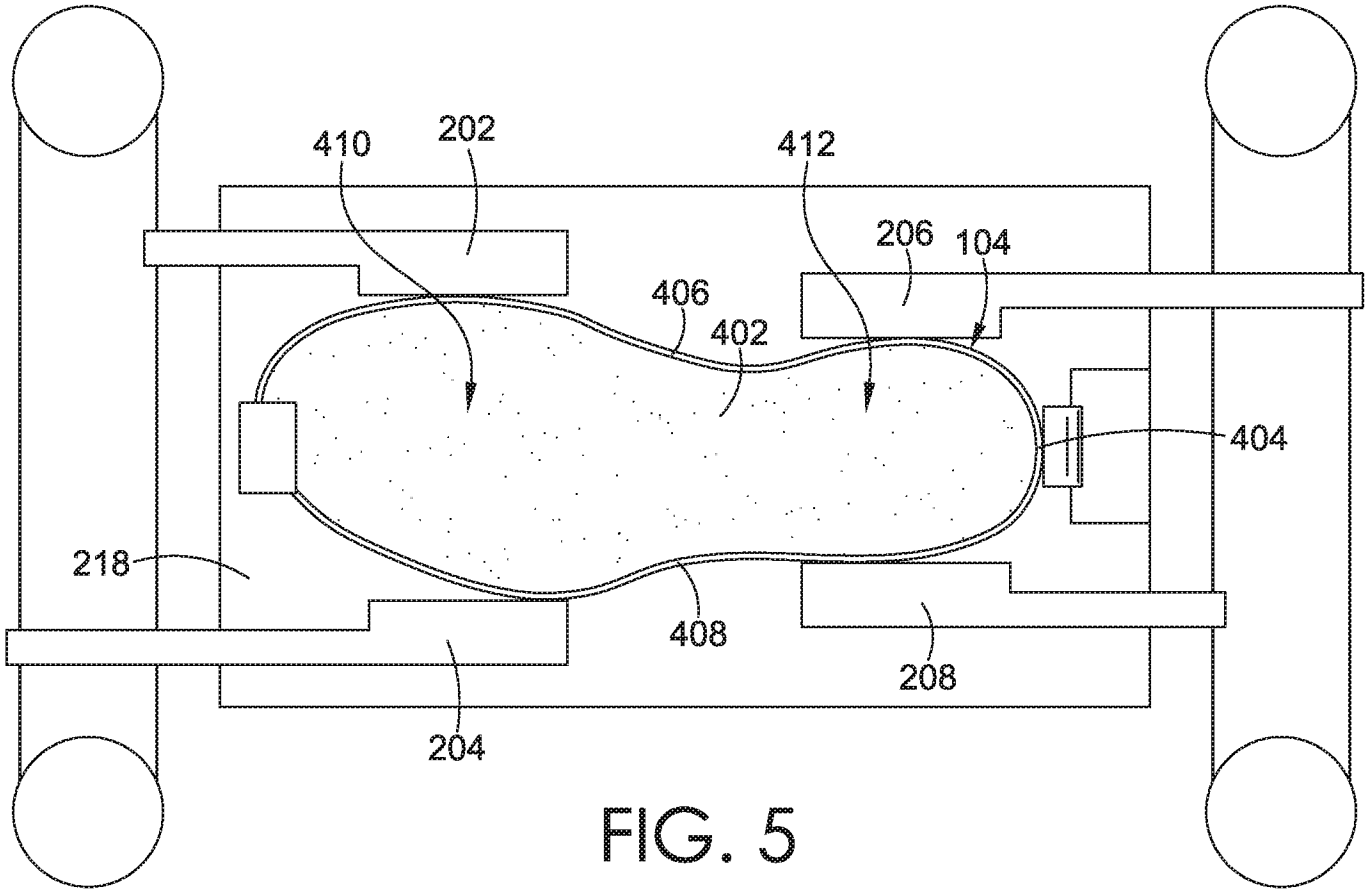
FIG. 5 depicts a top view of a sole engaged with a manufacturing apparatus as described herein, in accordance with aspects hereof, the perimeter deforming implements of the manufacturing apparatus being in a non-actuated position.
Figure 6:
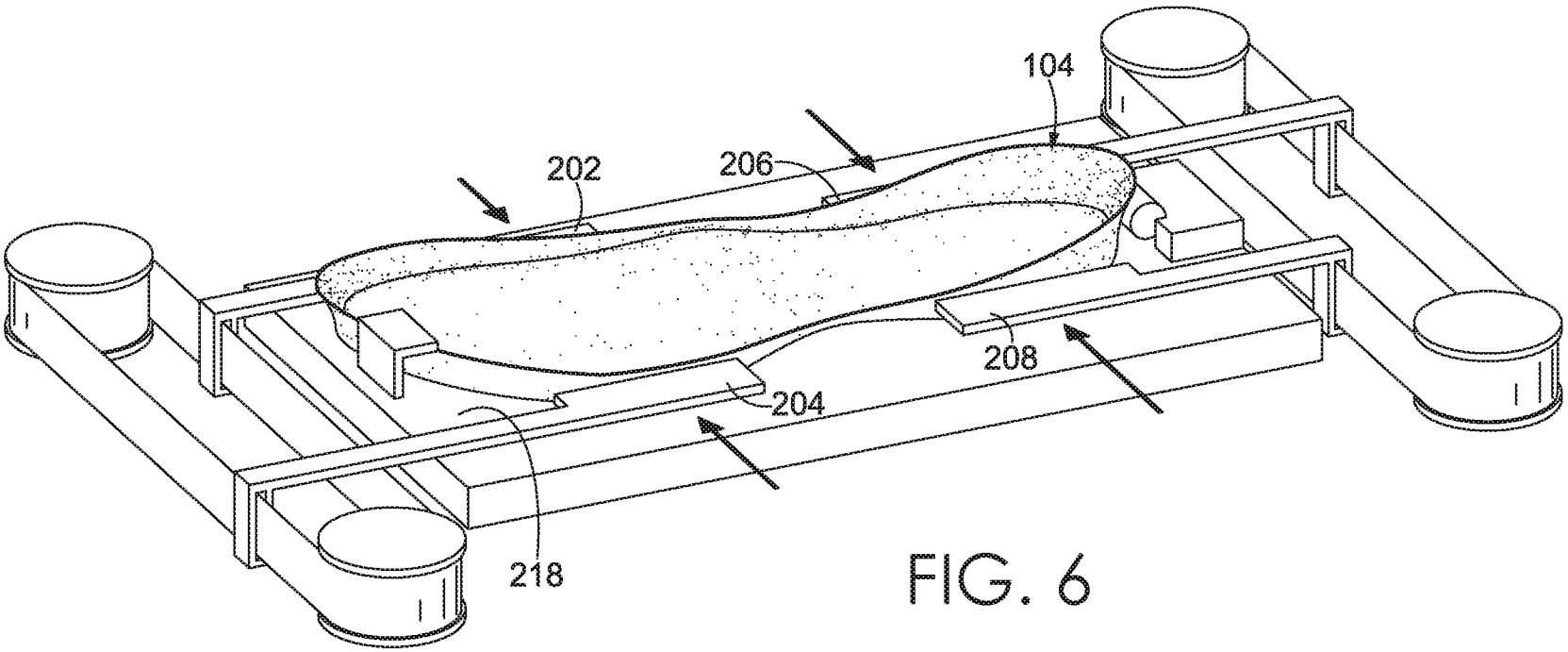
FIG. 6 depicts a perspective view of the exemplary manufacturing apparatus of FIG. 4 with the first and second pairs of clamps engaged, in accordance with aspects hereof.

With reference to FIG. 5, a top view is depicted of the secured sole 104 when the first and second perimeter deforming implements 214, 216 are not engaged and, accordingly, the sole 104 exhibits no splaying of the perimeter 404 of the top surface 402 thereof. FIG. 7, however, depicts a top view of the secured sole 104 when the first and second perimeter deforming implements 214, 216 are in their engaged state causing splaying of the top surface 402 of the sole 104 at least along the medial rim 406 and the lateral rim 408. This splaying or outward opening of the perimeter 404 of the top surface 402 of the sole 104 permits a cemented upper to be received by the top surface 402 of the sole 104 with decreased risk of unwanted contact between the sole 104 and the upper, as more fully described below.

Figure 7:
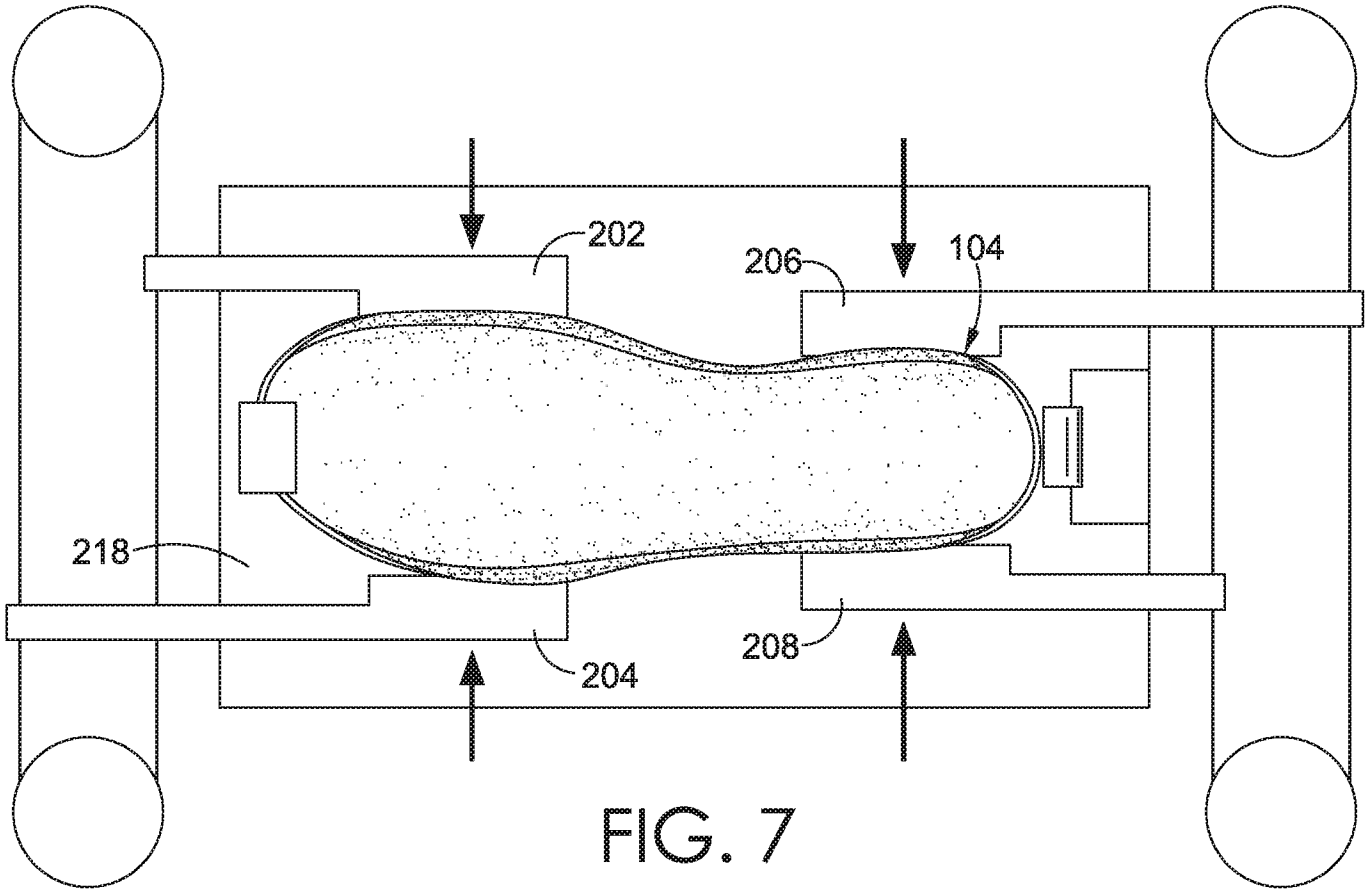
FIG. 7 depicts a top view of a sole engaged with a manufacturing apparatus as described herein, in accordance with aspects hereof, the perimeter deforming implements of the manufacturing apparatus being in an actuated position causing splaying of the perimeter of the top surface of the sole.
Figure 8:
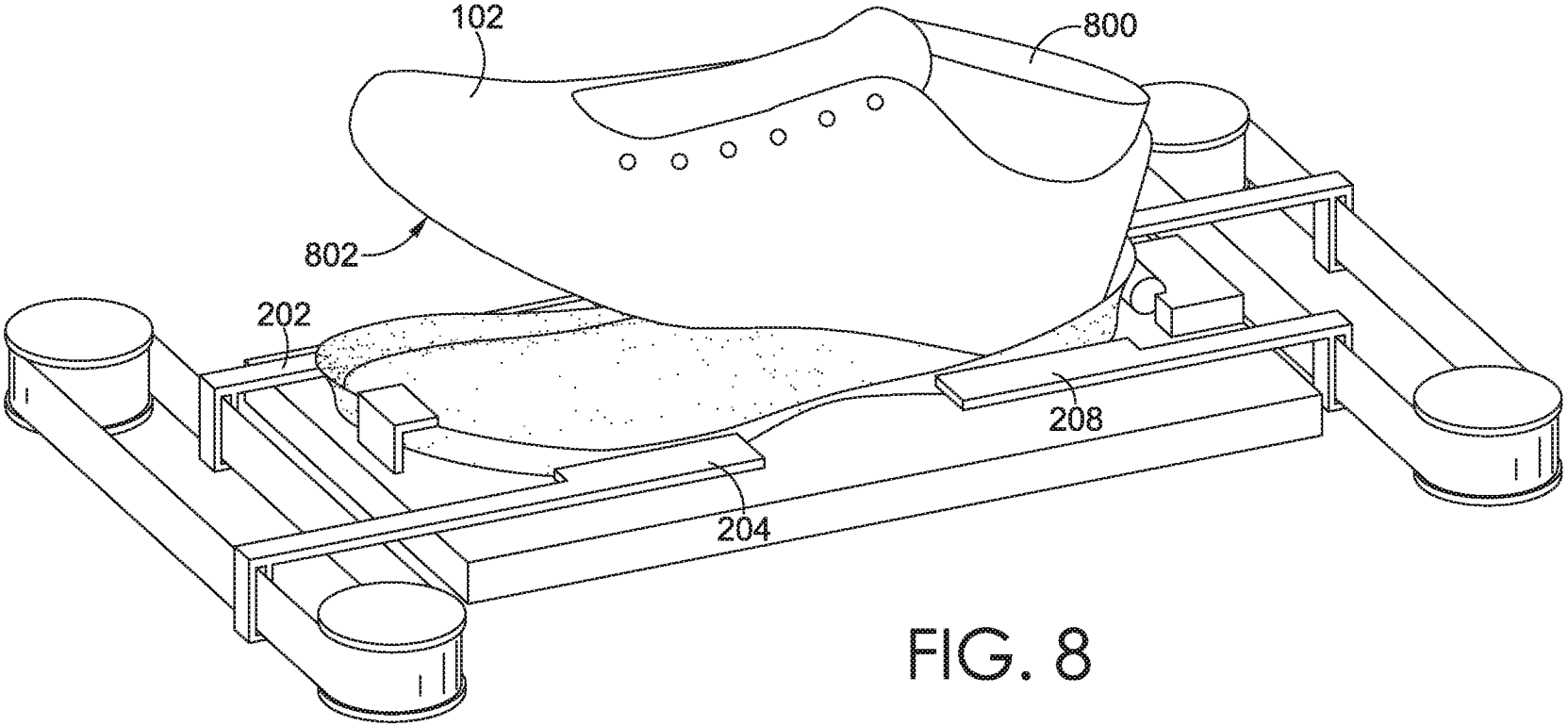
FIG. 8 depicts a heel-to-toe positioning of a cemented upper in cooperation with a secured sole, in accordance with aspects hereof.

Turning now to FIG. 8, depicted is placement of a cemented upper 102 on the top surface 402 of the secured sole 104 of FIG. 7. In aspects, the cemented upper 102 may include a last 800 coupled therewith during coupling with the sole 104. Placement of the cemented upper 102 may be in a longitudinal heel-to-toe direction as illustrated. Such placement may decrease any distortion of the sole 104 that may be experienced, for instance, by heel-to-toe placement of a cemented upper onto a sole that is not secured as described herein. Less distortion may result in articles of footwear having toe spring that matches the toe spring of the last 800 more closely than shoes manufactured utilizing prior art manufacturing methods.

Figure 9:
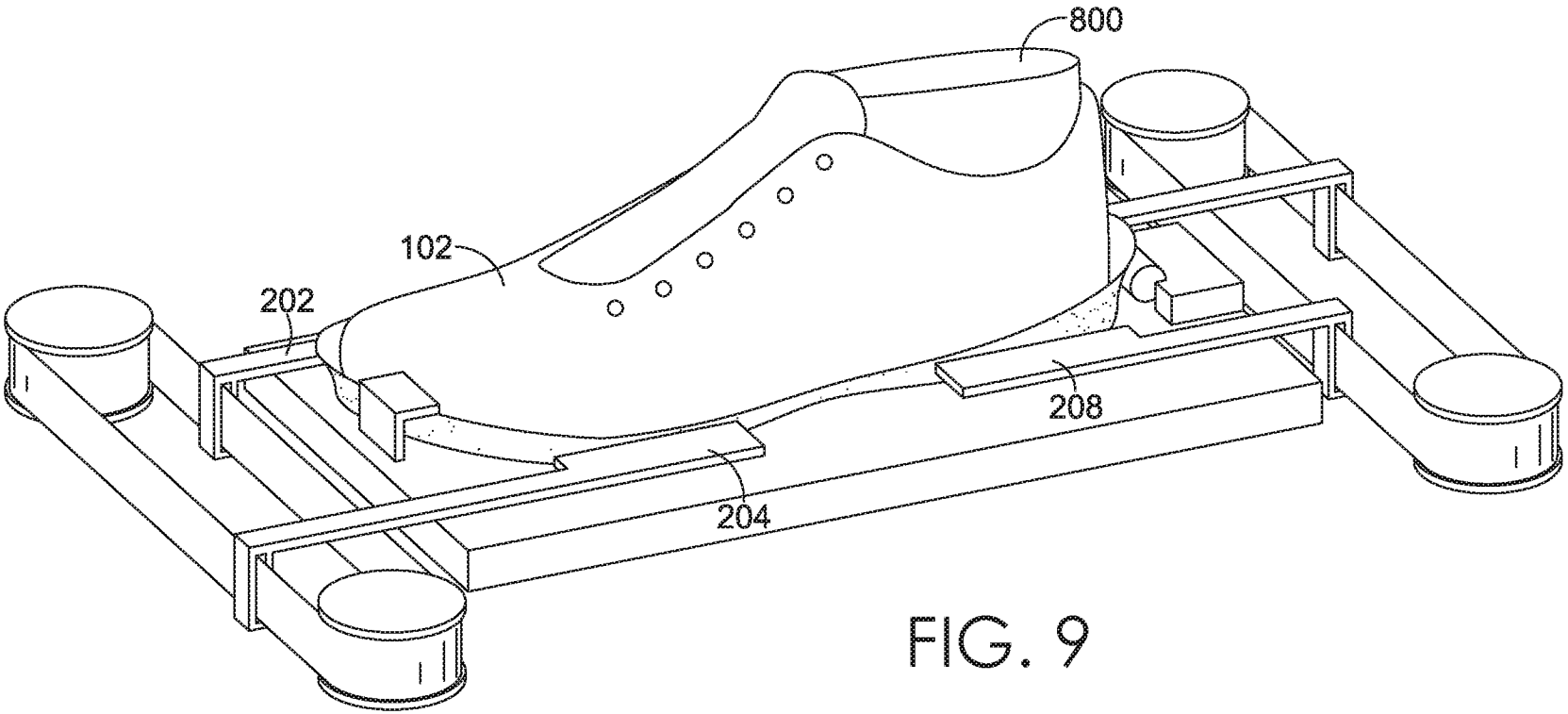
FIG. 9 depicts a cemented upper in cooperation with a secured sole, in accordance with aspects hereof.

FIG. 9 depicts the lasted upper 102 once a bottom surface 802 of the upper has made contact with the top surface 402 of the engaged sole 104 over the entire longitudinal length thereof. In aspects, once coupling of the bottom surface 802 of the upper 102 and the top surface 402 of the sole 104 is complete, the first and second perimeter deforming implements 214, 216 may be released, relaxing the deformity or outward splaying of the perimeter 404 of the top surface 402 of the sole 104. The first pair of clamps 202, 204 and the second pair of clamps 206, 208 similarly may be released releasing the shoe 100 (illustrated in FIG. 10) from the manufacturing apparatus 200. In aspects, the coupled upper 102 and sole 104 may be pressed at those areas of contact to ensure adequate adhesion.

Figure 11:
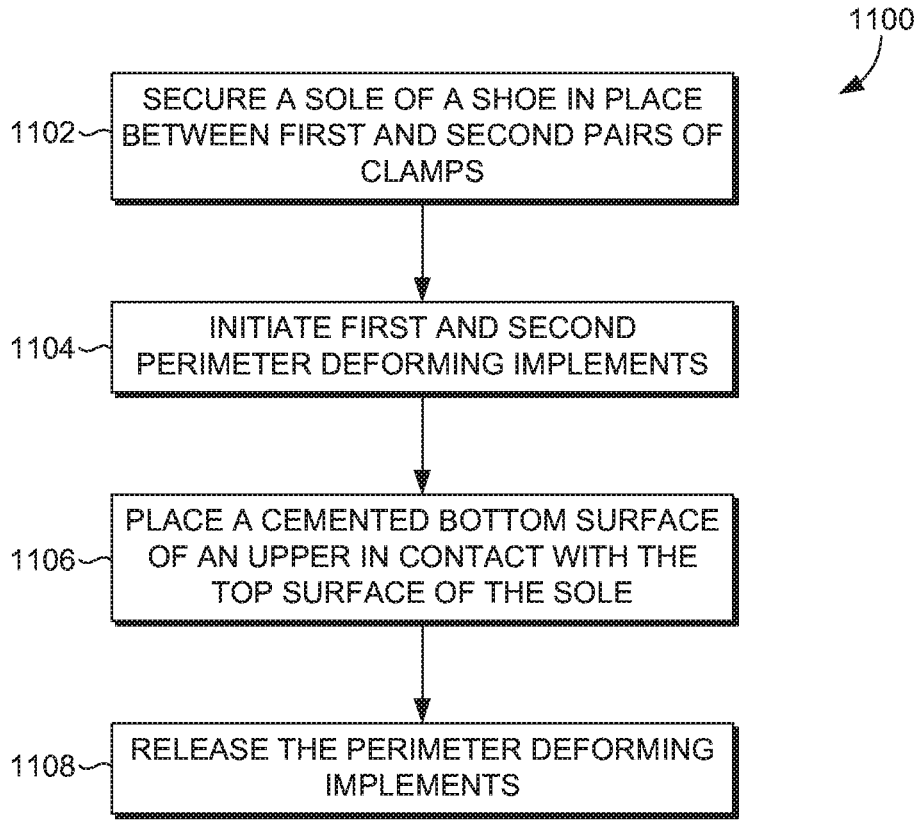
FIG. 11 depicts a flow diagram of a method of coupling an upper and a sole, in accordance with aspects hereof.

Aspects hereof additionally relate to methods of manufacturing articles of footwear utilizing a manufacturing apparatus as illustrated in FIGS. 1-9. FIG. 11 depicts a flow diagram showing a first exemplary method 1100 in accordance with aspects hereof. Initially, as indicated at block 1102, the sole of an article of footwear may be secured between first and second pairs of clamps of a manufacturing apparatus. In aspects, the manufacturing apparatus may be an apparatus similar the manufacturing apparatus 200 depicted in FIGS. 1-9 and the first pair of clamps may be clamps similar to those indicated by reference numerals 202, 204 and the second pair of clamps may be clamps similar to those indicated by reference numerals 206, 208 thereof. In aspects, the first pair of clamps cooperate with one another to secure a ball region of the sole and the second pair of clamps cooperate to secure a heel region of the sole.

As indicated at block 1104, first and second perimeter deforming implements may be initiated that apply pressure to a bottom surface of the secured sole. In aspects, such pressure causes a lateral rim and a medial rim of a perimeter of a top surface of the secured sole to open outwardly from a central longitudinal axis thereof. In aspects, the first perimeter deforming implement may be an implement similar to that indicated by reference numeral 214 and the second perimeter deforming implement may be an implement similar to that indicated by reference numeral 216 of FIGS. 1 through 3.

As indicated at block 1106, a bottom surface of an upper may be placed in contact with the top surface of the sole. In aspects, the bottom surface of the upper includes a not-yet-set adhesive applied thereto configured for coupling the upper and the sole and the bottom surface of the upper is placed into contact with the top surface of the sole in a heel-to-toe direction. Adhesives for securing uppers to soles of articles of footwear are known to those having ordinary skill in the art and, accordingly, are not further described herein.

As indicated at block 1108, the first and second perimeter deforming implements (and the first and second pairs of clamps) may be released such that the perimeter of the top surface of the sole closes around a perimeter of the upper adjacent the bottom surface of the upper, adhering the sole to the upper.

Figure 12:
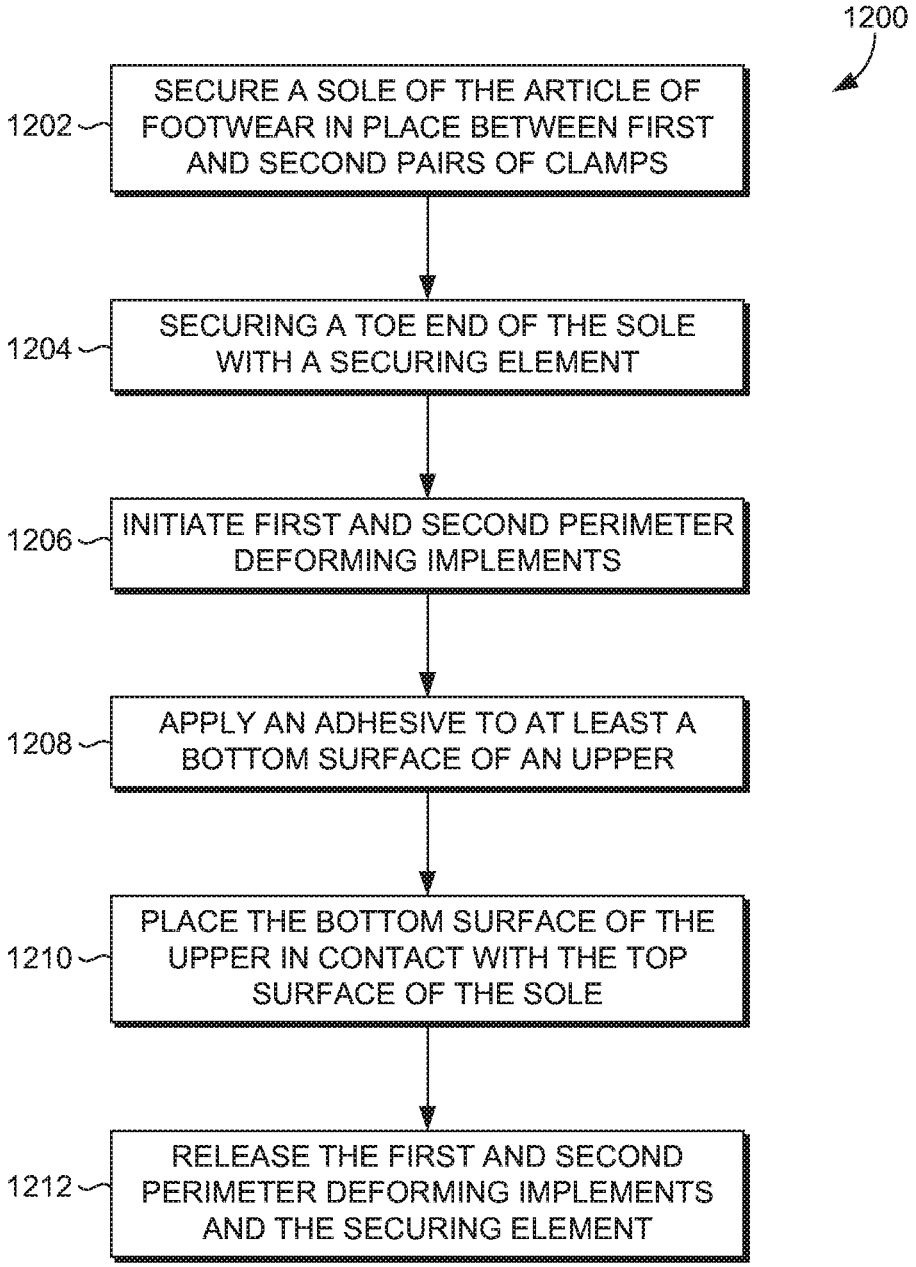
FIG. 12 depicts a flow diagram of another exemplary method of coupling an upper and a sole, in accordance with aspects hereof.

FIG. 12 depicts a flow diagram showing another exemplary method 1200 in accordance with aspects hereof. Initially, as indicated at block 1202, the sole of an article of footwear may be secured between first and second pairs of clamps of a manufacturing apparatus. In aspects, the manufacturing apparatus may be an apparatus similar the manufacturing apparatus 200 depicted in FIGS. 1-9 and the first pair of clamps may be clamps similar to those indicated by reference numerals 202, 204 and the second pair of clamps may be clamps similar to those indicated by reference numerals 206, 208 thereof. In aspects, the first pair of clamps cooperate with one another to secure a ball region of the sole and the second pair of clamps cooperate to secure a heel region of the sole.

As indicated at block 1204, a toe end of the sole may be secured with a toe securing element. In aspects, the toe securing element may be similar to the toe securing element indicated by reference numeral 234 in FIGS. 1 through 3. As indicated at block 1206, first and second perimeter deforming implements may be initiated that apply pressure to a bottom surface of the secured sole. In aspects, such pressure causes a lateral rim and a medial rim of a perimeter of a top surface of the secured sole to open outwardly from a central longitudinal axis thereof. In aspects, the first perimeter deforming implement may be an implement similar to that indicated by reference numeral 214 and the second perimeter deforming implement may be an implement similar to that indicated by reference numeral 216 of FIGS. 1 through 3.

As indicated at block 1208, an adhesive may be applied to at least a bottom surface of the upper. Adhesives for securing uppers to soles of articles of footwear, as well as their methods of application, are known to those having ordinary skill in the art and, accordingly, are not further described herein.

As indicated at block 1210, a bottom surface of an upper may be placed in contact with the top surface of the sole. In aspects, the bottom surface of the upper may be placed into contact with the top surface of the sole in a heel-to-toe direction. As indicated at block 1212, the first and second perimeter deforming implements and the toe securing element may be released such that the perimeter of the top surface of the sole closes around a perimeter of the upper adjacent the bottom surface of the upper, adhering the sole to the upper.

As can be seen, aspects hereof relate to a manufacturing apparatus for coupling a cemented upper and a sole of an article of footwear. Aspects hereof further relate to a method of manufacturing articles of footwear, for instance, shoes, utilizing a manufacturing apparatus as described herein. A manufacturing apparatus having a structure as described herein permits the accurate coupling a cemented upper and a sole in a manner that requires less skill and training than conventional methods. A manufacturing apparatus having a structure as described herein further permits the reduction of waste occasioned by improperly adhered and consequently unusable articles.

Although the manufacturing apparatus and method are described above by referring to particular aspects, it should be understood that modifications and variations could be made without departing from the intended scope of protection provided by the following claims. It will be understood that certain features and sub-combinations are of utility and may be employed without reference to other features and sub-combinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible aspects may be made of the disclosure without departing from the scope thereof, it is to be understood that all matter herein set forth or shown in the accompanying drawings is to be interpreted as illustrative and not in a limiting sense.

What is claimed is:

1. A method of manufacturing an article of footwear, comprising:

securing a sole of the article of footwear in place between first and second pairs of clamps, the first pair of clamps cooperating to secure a ball region of the sole and the second pair of clamps cooperating to secure a heel region of the sole;

initiating first and second perimeter deforming implements that apply pressure to a bottom surface of the secured sole causing a lateral rim and a medial rim of a perimeter of a top surface of the secured sole to open outwardly from a central longitudinal axis of the sole;

placing a bottom surface of an upper in contact with the top surface of the sole, the bottom surface of the upper having an adhesive applied thereto; and releasing the first and second perimeter deforming implements such that the perimeter of the top surface of the sole closes around a perimeter of the upper adjacent the bottom surface of the upper, adhering the sole to the upper.

2. The method of claim 1, wherein at least one of the first pair of clamps and the second pair of clamps is movable in one or both of a lateral direction and a longitudinal direction to accommodate a plurality of articles of footwear of varying sizes.

3. The method of claim 2 further comprising securing a toe end of the sole in place with a securing element that applies downward pressure to the toe end.

4. The method of claim 1, wherein placing the bottom surface of the upper in contact with the top surface of the sole comprises placing the bottom surface of the upper in contact with the top surface of the sole in the longitudinal direction of the sole from the heel end to the toe end.

5. The method of claim 1, wherein the first pair of clamps includes a media clamp positioned at the ball region of a medial edge of the sole and a lateral clamp positioned at the ball region of the lateral edge of the sole, and wherein the second pair of clamps includes a medial clamp positioned at the heel region of the medial edge of the sole and a lateral clamp positioned at the heel region of the lateral edge of the sole.

6. The method of claim 1, wherein the first perimeter deforming implement is positioned within the ball region of the sole at or near the central longitudinal axis thereof, and wherein the second perimeter deforming implement is positioned within the heel region of the sole at or near the central longitudinal axis of thereof.

7. The method of claim 1, wherein applying the adhesive to at least the bottom surface of the upper comprises applying the adhesive to a bottom surface of the upper and a perimeter of the upper adjacent the bottom surface thereof.

8. The method of claim 1, wherein placing the bottom surface of the upper in contact with the top surface of the sole comprises placing the bottom surface of the upper in contact with the top surface of the sole in the longitudinal direction of the sole from the heel end to the toe end.

9. The method of claim 1, wherein the first pair of clamps includes a medial clamp positioned at the forefoot region of a medial edge of the sole and a lateral clamp positioned at the forefoot region of the lateral edge of the sole, and wherein the second pair of clamps includes a medial clamp positioned at the heel region of the medial edge of the sole and a lateral clamp positioned at the heel region of the lateral edge of the sole.

10. The method of claim 1, wherein the first perimeter deforming implement is positioned within the ball region of the sole at or near the central longitudinal axis thereof, and wherein the second perimeter deforming implement is positioned within the heel region of the sole at or near the central longitudinal axis thereof.

11. The method of claim 1 further comprising initiating an element to secure a toe end of the sole in place prior to initiating the first and second perimeter deforming implements.

* * * * *